United States Patent [19]

Djukic

[11] Patent Number: 4,527,571

[45] Date of Patent: Jul. 9, 1985

[54] SMOKING PIPE ASSEMBLY

[76] Inventor: Spasa Djukic, 716 Judie Dr., Cleveland, Ohio 44109

[21] Appl. No.: 511,421

[22] Filed: Jul. 6, 1983

[51] Int. Cl.[3] ..... A24F 3/00; A24F 5/00; A24F 7/02

[52] U.S. Cl. ..... 131/329; 131/178; 131/186; 131/196; 131/222; 131/224; 131/225; 131/226; 131/227

[58] Field of Search ..... 131/329, 180, 196, 226, 131/178, 224, 222, 227, 225; D27/315

[56] References Cited

U.S. PATENT DOCUMENTS

| | | | |
|---|---|---|---|
| 3,091,246 | 5/1963 | Mahieux | 131/196 |
| 3,397,703 | 8/1968 | Otto | 131/196 |
| 4,294,267 | 10/1981 | Glymph | 131/180 |

*Primary Examiner*—V. Millin

*Attorney, Agent, or Firm*—John M. Romanchik, Jr.

[57] ABSTRACT

A key chain pipe assembly having a bowl, stem, and storage container which forms a cylinder when assembled in one mode for attaching to a key chain or the like and the parts can be disassembled and reassembled in another mode to form a pipe for smoking.

7 Claims, 4 Drawing Figures

SMOKING PIPE ASSEMBLY

BACKGROUND OF THE INVENTION

The present invention generally relates to smoking devices, and more particularly to a key chain smoking device which can be smoked as a normal pipe or attached to a key chain as a novelty item.

Heretofore, there have been various smoking devices known. Of particular interest are smoking pipes which are normally used only during the smoking process. Such pipes are usually stored in a pipe rack because of their bulkiness and removed by the user only when intending to smoke. Typically, these pipes are too large to be carried and not too adapted for attaching to a key chain or for assembly in a compact form.

SUMMARY OF THE INVENTION

Accordingly, it is an object of the present invention to provide a key chain smoking devise which is adapted for easy carrying by the user.

It is another object to provide a novel smoking device which assembles to a compact form for attaching to a key chain or the like and easy carrying.

It is still another object to provide a novel smoking device assembly which can be readily reassembled from a key chain novelty item to a pipe which can be smoked.

It is a further object to provide a smoking device having threaded parts for simple assembly without the need for tools.

It is still a further object to provide a smoking pipe assembly having threads exterior to the bowl to avoid clogging from smoking.

It is yet a further object to provide a key chain pipe assembly having a storage space for tobacco.

In order to achieve the above objects, as well as others which will become apparent hereafter, the present invention for key chain pipe comprises a functional pipe device for attaching to a key chain. The smoking device has a tobacco receiving portion for the purpose of receiving smoking tobacco for buring same. A stem with a mouthpiece is provided which has a conduit for carrying smoke from said tobacco receiving portion to said mouthpiece.

In a presently preferred embodiment said pipe device includes a cylindrical or other shaped body having a ring at one end for support means for attaching to a key chain. Said device is adapted for disassembly to a tobacco receiving portion in which a stem is fastened for providing a conduit for smoke to travel to a mouthpiece at the end of said stem and to the mouth of the user. Said cylinder also includes a cap for covering said tobacco receiving portion and a hollow tobacco storing portion for attaching together and enhancing the aesthetic features of said novelty key chain pipe.

BRIEF DESCRIPTION OF THE DRAWINGS

With the above and additional objects and advantages in view, as well hereafter appear, this invention comprises the device, combinations and arrangement of parts hereinafter described and illustrated in the accompanying drawings of a preferred embodiment in which.

DESCRIPTION OF THE PREFERRED EMBODIMENT

Figure 1:
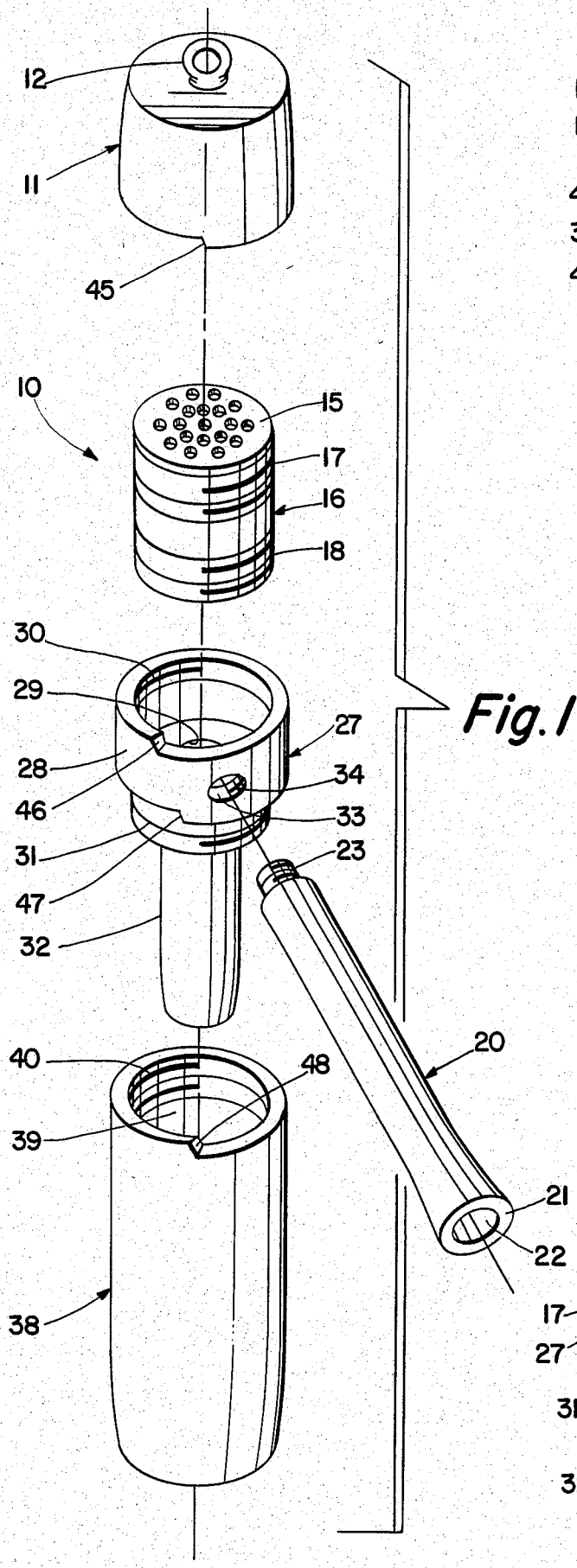
FIG. 1 is an exploded perspective view of a key chain pipe assembly which shows the various parts for assembly and attaching to a key chain in accordance with the present invention.

Referring now specifically to the drawings, in which identical or similar parts are designated by the same reference numeral throughout, and first referring to FIG. 1, a key chain pipe assembly in accordance with the present invention is shown and generally designated by the reference 10.

Figure 2:
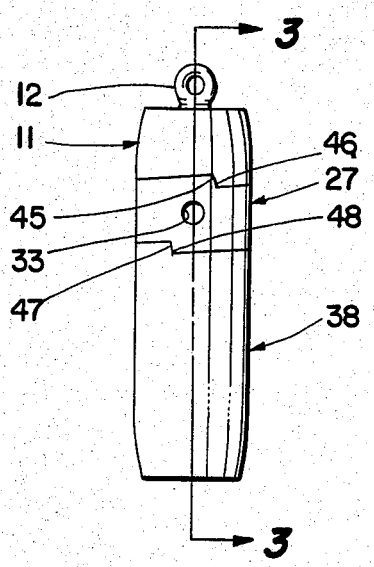
FIG. 2 is a frontal perspective view of the present invention as assembled for attaching to a key chain.
Figure 3:
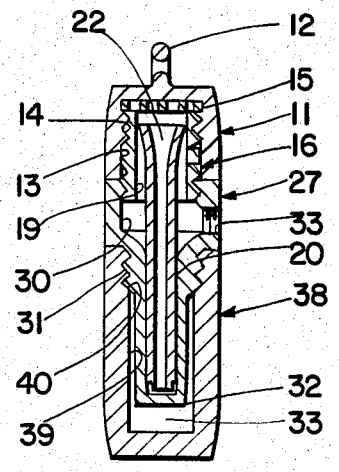
FIG. 3 is a cross section through the device on line 3—3 of FIG. 2.
Figure 4:
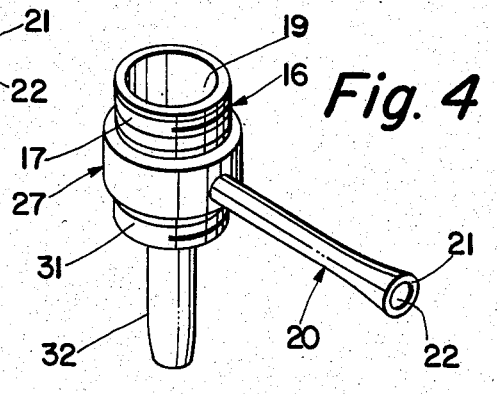
FIG. 4 is a perspective view showing the mouthpiece assembled for smoking in accordance with the present invention.

The key chain pipe assembly 10 is in the nature of a smoking device which is both functional and ornamental. The key chain pipe assembly 10 includes a pipe tobacco receiving portion or bown and cap 11. Cap 11 is hollow and has a bore 14 which threads 13 are formed. Bowl 16 has threads 17 for engaging matching threads 13 in cap 11 for assembly as shown in FIG. 2. The cap 11 has a ring 12 for attaching to a key chain or the like and easy carrying in the pocket of a user. Bowl 16 is shown in FIG. 1 in a position for assembly as shown in FIG. 2. Threads 18 on bowl 16 engage matching threads in bowl housing 27 for assembly in the storage mode as shown in FIG. 2 and FIG. 3. The bowl 16 is inverted for use as a smoking pipe and screwed into bowl housing 27 with threads 17 engaging bowl housing threads 30. Bowl 16 has a bore 16 which together with screen 16 forms a chamber for receiving tobacco for smoking use as shown in FIG. 4. Screen 15 can be formed in bowl 16 when casting or formed separately and attached by welding or cementing. Screen 15 forms the bottom of the tobacco holding chamber in bowl 16 when screwed into bowl housing 27 as shown in FIG. 4.

Bowl housing 27 is hollow for storing pipe stem 20 within bore 29 when assembled in the storage mode shown in FIG. 2 and FIG. 3. Bowl housing has a hole 33 with threads 34 for receiving stem 20 threads 23 and supporting the stem for smoking. Threads 31 are formed or machined in bowl housing 27 for engagement with threads 40 on bottom housing 38. While bowl 27 is shown as a cylindrical body 28 matching the cap 11 and bottom housing 38, it can be appreciated that other container geometric shapes may be used. The bowl housing 27 bottom 32 is hollow also for receiving pipe stem 20 when in the storage mode in FIG. 2 and FIG. 3. Bottom 32 also provides a place for holding the pipe of FIG. 4 when smoking. Stop 46 of bowl housing 27 engages stop 45 of cap 11 and stop 47 engages stop 48 of bottom housing 38. As can be observed from FIG. 3, bowl housing 27 is received within bottom housing 38 bore 39 while assembled in the storage mode.

In FIG. 4, the smoking mode is shown with pipe stem 20 screwed into bowl housing 27. Pipe stem 20 has a hole 22 formed for providing a conduit for smoke to travel from bowl 16 through to mouthpiece 21 and into the user's mouth.

Bottom housing 38 receives bowl housing 27 when in the storage mode shown in FIG. 3. A space 33 is provided between the bottom of bowl housing 27 and bottom housing 38 for conviently storing tobacco for the user. The capacity of space 33 can be varied to provide the quantity of tobacco according to the wishes of the consumer.

The key chain pipe 10 may be cast from metals such as brass or plastics or other materials that are able to withstand the heat experienced while smoking. As should be clear, burning of tobacco within bowl 16 causes it to be heated to relatively high temperatures, particularly when hot smoke is drawn through pipe stem 20. Accordingly, while the key chain pipe 10 may be made from any suitable material, it should be made from a material which can be exposed to the anticipated high temperatures without burning, warping or otherwise becoming damaged. For example, ceramics, metals and high temperature molded elastomeric materials may be used for this purpose.

The key chain pipe 10 can be formed by casting suitable materials in a mold. Also, the key chain pipe 10 can be formed by machining or by a combination of casting the parts and machining where necessary.

The invention shown here is in the shape of a cylinder but other shapes can be used without departing from the concept. It should be clear from FIG. 2 that the dimensions of the key chain pipe 10 are small such that it can readily fit into the palm of a hand and be attached to a key chain or the like.

Numerous alterations of the structure herein disclosed will suggest themselves to those skilled in the art. However, it is to be understood that the present disclosure relates to a preferred embodiment of the invention which is for illustration only and is not to be construed as limitations of the invention.

What is claimed is:

1. A key chain pipe assembly comprising a tobacco receiving portion, a stem, a segmented hollow housing encircling said tobacco receiving portion and stem, means for assembly and disassembling of said tobacco receiving portion, stem and housing from a storage mode to a pipe smoking mode, and means for attaching said housing to a key chain or the like.

2. A key chain pipe assembly as defined in claim 1 wherein said housing is cylindrical.

3. A key chain pipe assembly as defined in claim 1 wherein said means for attaching to a key chain is a ring formed on said housing.

4. A key chain pipe assembly as defined in claim 1 wherein said segmented housing has stop portions on each segment for limiting the distance said segments can be screwed together.

5. A key chain pipe assembly as defined in claim 4 wherein said housing has a space for storing tobacco.

6. A key chain pipe assembly as defined in claim 1 wherein said threads are formed exterior to said tobacco receiving portion to avoid cloging with tobacco and tar when smoking.

7. A key chain pipe assembly as defined in claim 6 wherein said tobacco receiving portion is a cylindrical bowl having a screen at one end for holding tobacco therein and permitting smoke to flow therethrough.

* * * * *